US007553201B2

(12) United States Patent
Imai

(10) Patent No.: US 7,553,201 B2
(45) Date of Patent: Jun. 30, 2009

(54) CONNECTOR

(75) Inventor: Yuujirou Imai, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/165,796

(22) Filed: Jul. 1, 2008

(65) Prior Publication Data

US 2009/0011661 A1 Jan. 8, 2009

(30) Foreign Application Priority Data

Jul. 3, 2007 (JP) ..... 2007-175209

(51) Int. Cl.
*H01R 4/48* (2006.01)

(52) U.S. Cl. ..... 439/834; 439/95; 439/108; 439/610; 439/578; 439/939

(58) Field of Classification Search ..... 439/92, 439/95, 96, 98, 100, 101, 108, 578, 610, 439/834, 939
See application file for complete search history.

(56) References Cited

U.S. PATENT DOCUMENTS 4,371,226 A 2/1983 Brancaleone
5,240,425 A * 8/1993 Sato et al. ..... 439/100
5,433,633 A * 7/1995 Matsumoto et al. ..... 439/607
5,964,620 A 10/1999 Takahashi et al.
6,099,352 A * 8/2000 Yamaguchi ..... 439/610
6,171,150 B1 1/2001 Saito et al.
6,554,646 B1 4/2003 Casey
2009/0011661 A1* 1/2009 Imai ..... 439/834

FOREIGN PATENT DOCUMENTS

DE 202005007221 U1 9/2006

* cited by examiner

*Primary Examiner*—James Harvey
(74) *Attorney, Agent, or Firm*—Gerald E. Hespos; Anthony J. Casella

(57) ABSTRACT

A connector (10) is provided with a housing (11) to be mounted on an electrically conductive bracket (B), a plurality of terminal fittings (12) connected with coaxial cables each including an outer conductor as a ground wire and to be mounted in the housing (11), and a plurality of split ground terminals (13) to be mounted in the housing (11) and including circuit-side contact pieces (38) to be brought into contact with outer conductor terminals (14) of the terminal fittings (12) connected with the outer conductors and bracket-side contact pieces (40) to be brought into contact with the bracket (B).

16 Claims, 17 Drawing Sheets

CONNECTOR

BACKGROUND OF THE INVENTION

1. Field of the Invention

The invention relates to a connector.

2. Description of the Related Art

U.S. Pat. No. 5,433,633 relates to a connector with a ground terminal for connection of a ground wire included in an electric wiring of an automotive vehicle to a body. The connector includes a housing to be mounted on a bracket fixed to the vehicle body. The connector also includes a terminal fitting and a ground terminal in the housing. The terminal fitting is connected with an inner conductor of a coaxial cable and the ground terminal connects an outer conductor (ground wire) of the coaxial cable to the bracket that is fixed to the vehicle body. The ground terminal is inserted into the housing and includes a circuit-side contact to be brought into contact with the outer conductor and a bracket-side contact to be brought into contact with the bracket.

Plural terminal fittings may be accommodated in a housing and outer conductors of coaxial cables connected with these terminal fittings must be connected respectively with a bracket. This arrangement requires an undesirable enlargement of the ground terminal. Additionally the ground terminal must have plural circuit-side contact portions. Thus, the ground terminal becomes complicated and is difficult to form by press working. Furthermore, the complex ground terminals are not easily formed as a chain that can be formed into a hoop.

The invention was developed in view of the above and an object is to provide a connector for connecting a bracket to ground wires of a plural of cables.

SUMMARY OF THE INVENTION

The invention relates to a connector with a housing that can be mounted on an electrically conductive bracket. The connector also includes terminal fittings to be connected with cables, including ground wires, and to be mounted in the housing. The terminal fittings include split ground terminals each of which includes at least one circuit-side contact to be connected with the ground wire and/or with a terminal fitting connected with the ground wire. Each split ground terminal also has at least one bracket-side contact to be connected with the bracket and to be mounted into the housing. Thus, the respective ground wires are connected electrically with the bracket. The split ground terminals can be small and simple to facilitate production, as compared to a case where one ground terminal has all of the circuit-side contacts.

At least one partition is provided in the housing for partitioning and positioning the bracket and the split ground terminals.

The bracket and the split ground terminals are mounted into the housing in substantially the same direction. Additionally, the partition is exposed in a front end of the housing with respect to the mounting direction of the bracket and the split ground terminals. Thus, the partition guides the bracket and the split ground terminals into the housing to provide good operational efficiency.

The respective bracket-side contacts preferably are arranged in one direction and are brought into contact with the same plate surface of the bracket. Thus, the bracket can have a straight shape and the construction of the housing that receives the bracket can be simplified.

The terminal fittings preferably are arranged at plural levels in the housing. Thus, the respective circuit-side contacts are brought into contact with the ground wires and/or the terminal fittings connected with the ground wires from outer sides with respect to an arranging direction of the levels of the terminal fittings. The respective bracket-side contacts preferably are arranged in the arranging direction of the levels of the terminal fittings. With this construction, arrangement efficiency is improved in the connector and the connector can be miniaturized.

The respective bracket-side contacts preferably are brought into contact with the bracket at substantially symmetrical positions. Thus, the bracket-side contacts can be brought into contact with the bracket in a well-balanced manner and a good contact performance can be obtained.

The terminal fittings preferably are arranged at plural levels in the housing, and the terminal fittings in adjacent levels preferably are offset from each other. With this construction, the arrangement efficiency of the terminal fittings in the housing is improved, and the connector is well suited for miniaturization.

The housing preferably has terminal-fitting retaining pieces that resiliently engage the mounted terminal fittings. The terminal-fitting retaining pieces preferably are at sides of the terminal fittings opposite the circuit-side contacts. Thus, the terminal-fitting retaining pieces receive the terminal fittings resiliently and maintain a good contact state with the circuit-side contacts.

The housing preferably has a bracket lock for locking the bracket. The bracket lock is at a side of the bracket opposite the bracket-side contacts. Thus, the bracket can be narrow and the connector can be made smaller as compared with the case where the bracket-side contacts and the bracket lock are at the same side.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector in accordance with the invention is described with reference to FIGS. 1 to 20 and is identified by the numeral 10 in FIGS. 12 to 14 and 19. The connector 10 is to be mounted on a bracket B that is fixed or fixable to a body of an automotive vehicle (not shown). In the following description, an inserting direction of terminal fittings 12 and the bracket B (leftward direction in FIG. 12) is referred to as the forward direction, the opposite direction (rightward direction in FIG. 12) as a rearward direction. Additionally, reference is made to FIGS. 2 and 12 concerning the vertical direction. The terminal fittings 12 are not shown in FIGS. 15 and 16.

Figure 3:
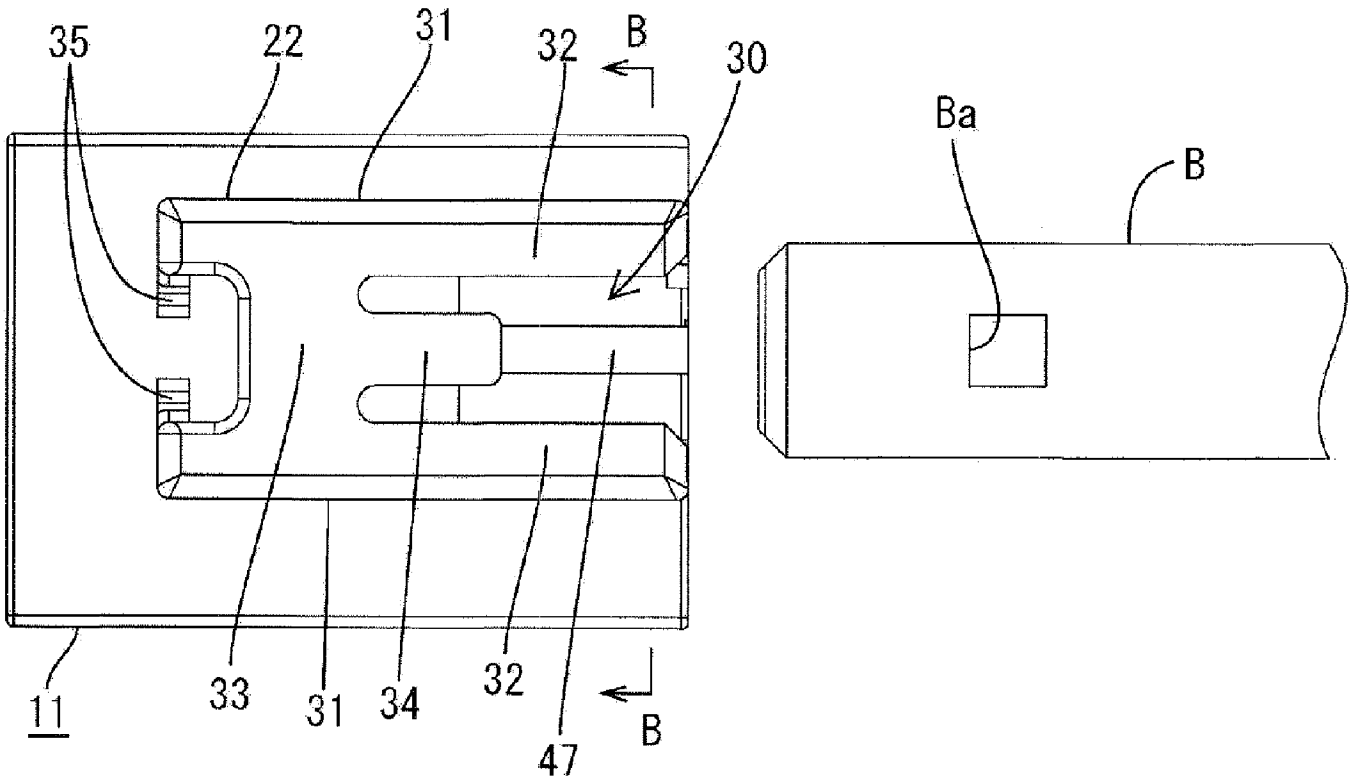
FIG. 3 is a side view of the housing and a bracket.
Figure 15:
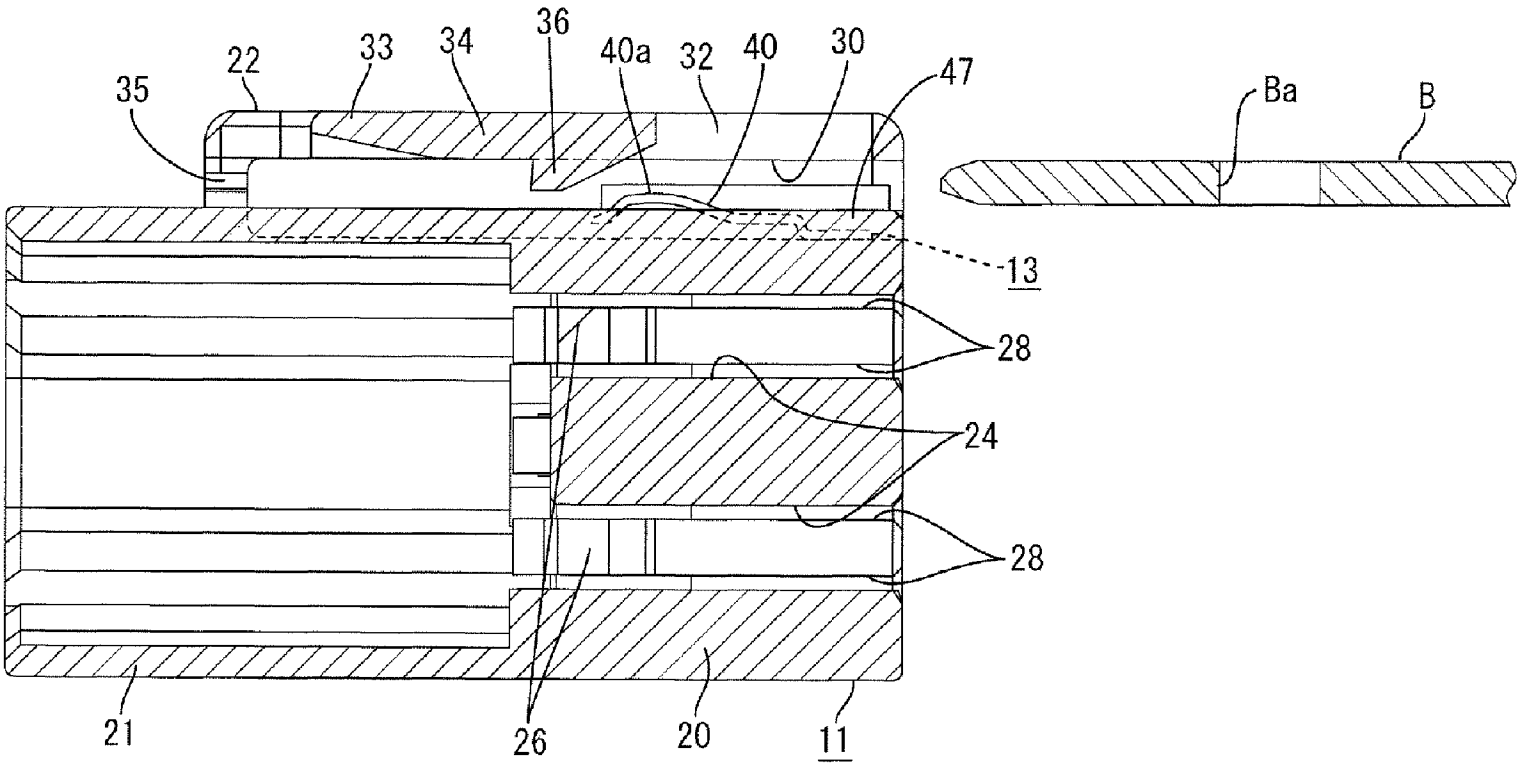
FIG. 15 is a section along C-C of FIG. 2 showing a state before the bracket is inserted into the housing mounted with the split ground terminals and the terminal fittings.

The bracket B is made of an electrically conductive material (such as metal) and defines a wide plate that projects from a position fixed to the body, as shown in FIGS. 3 and 15. A lock hole Ba penetrates the bracket B in the thickness direction at a widthwise intermediate position near the leading end. The leading end of the bracket B is beveled over substantially the entire periphery for smooth insertion into the connector 10.

Figure 12:
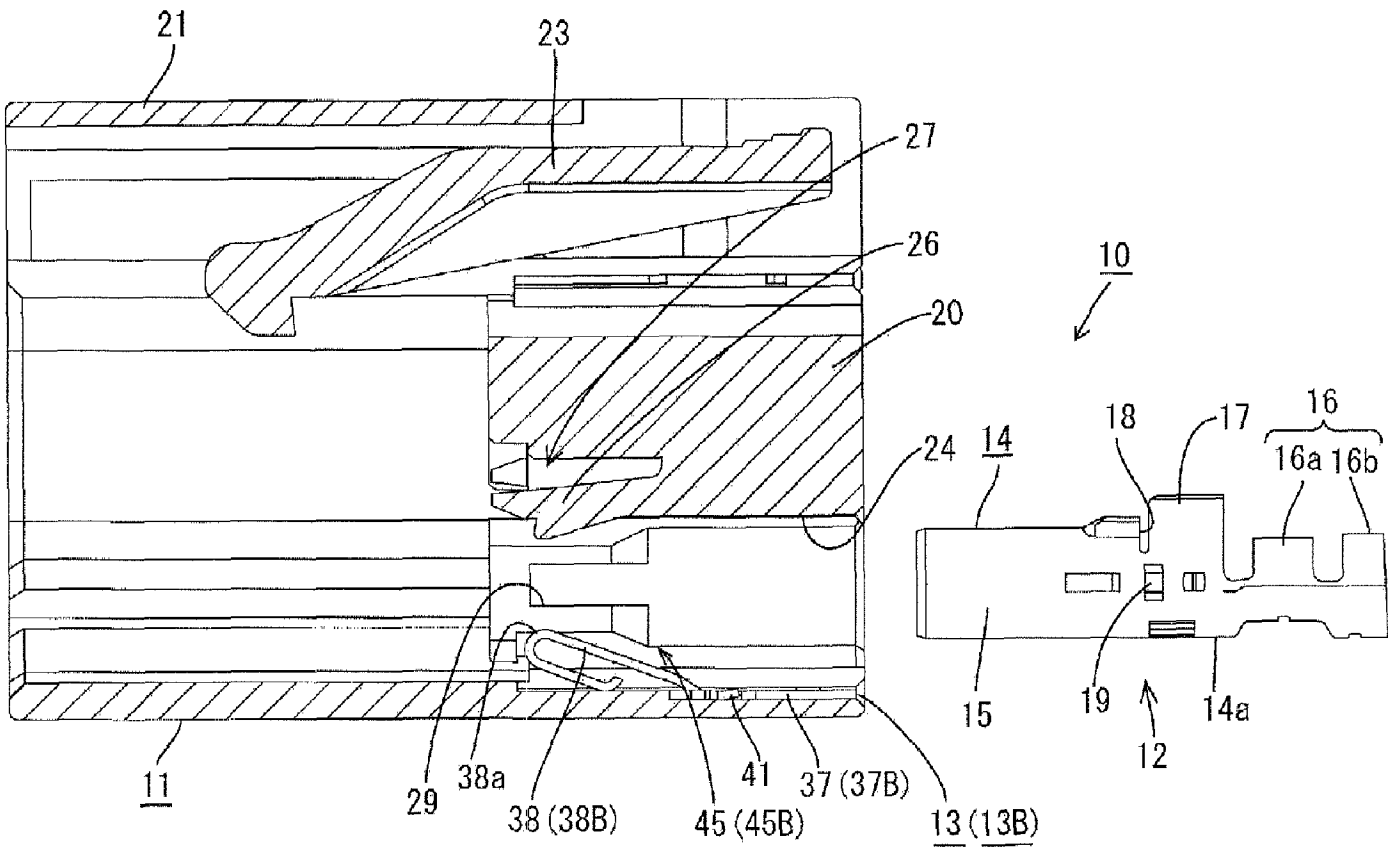
FIG. 12 is a section along A-A of FIG. 2 showing a state before the terminal fittings are inserted into the housing mounted with the split ground terminals.

The connector 10 has a housing 11 and terminal fittings 12 are mounted in the housing 11, as shown in FIG. 12. The terminal fittings 12 are to be connected with ends of coaxial cables (not shown). Split ground terminals 13 also are mounted in the housing 11 and electrically connect some of the terminal fittings 12 to the bracket B. The connector 10 is connected with a mating connector (not shown) while being mounted on the bracket B.

Each coaxial cable has an inner conductor, an inner insulating layer, an outer conductor (such as braided wire or conductive film) and an outer sheath coaxially provided in this order from an axial center. The inner conductor forms a signal wire of an electric circuit of the automotive vehicle and the outer conductor forms a ground wire of this electric circuit.

Figure 4:
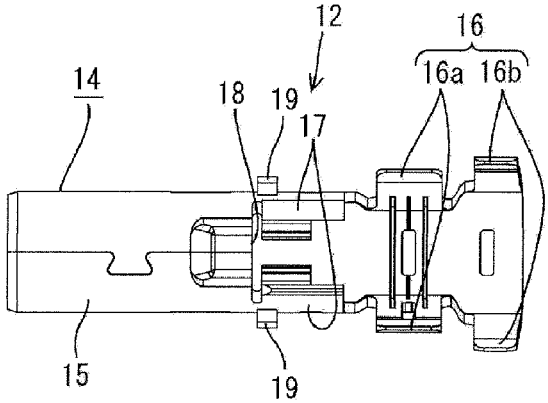
FIG. 4 is a plan view of a terminal fitting.

Each terminal fitting 12 has an inner terminal (not shown) to be connected with the inner conductor of the coaxial cable. An outer terminal 14 is arranged outside the inner terminal and is to be connected with the outer conductor of the coaxial cable, as shown in FIGS. 4 and 12. An insulating body (not shown) is disposed between the inner terminal and the outer terminal 14 to provide electrical insulation therebetween. The outer terminal 14 has a substantially cylindrical tubular main portion 15 that surrounds the inner terminal. A cable connecting portion 16 is unitary with the main portion 15 and includes two front crimping pieces 16*a* and two rear crimping pieces 16*b*. The front crimping pieces 16*a* are crimped into connection with the outer conductor exposed at an end of the coaxial cable and the rear crimping pieces 16*b* are crimped to the outer sheath.

The main portion 15 has a bottom plate 14*a* that extends continuously from the main portion 15 to the cable connecting portion 16 and two stabilizers 17 are formed at the rear end of the main portion 15 at a side opposite the bottom plate 14*a*. The stabilizers 17 are substantially flat plates that project in a vertical direction of FIG. 12 and face each other at opposite sides of the main portion 15 with an open part located therebetween. A lance engaging portion 18 is embossed out at the front edge of the open part of the main portion 15 between the stabilizers 17. Two projections 19 are cut and bent to project out from positions on the main portion 15 spaced from the stabilizers 17 by an angle of about 90°. The inner terminal is to be connected electrically with a mating terminal of the mating connector connected with the connector 10 to form the signal wire of the electrical circuit of the vehicle.

Figure 1:
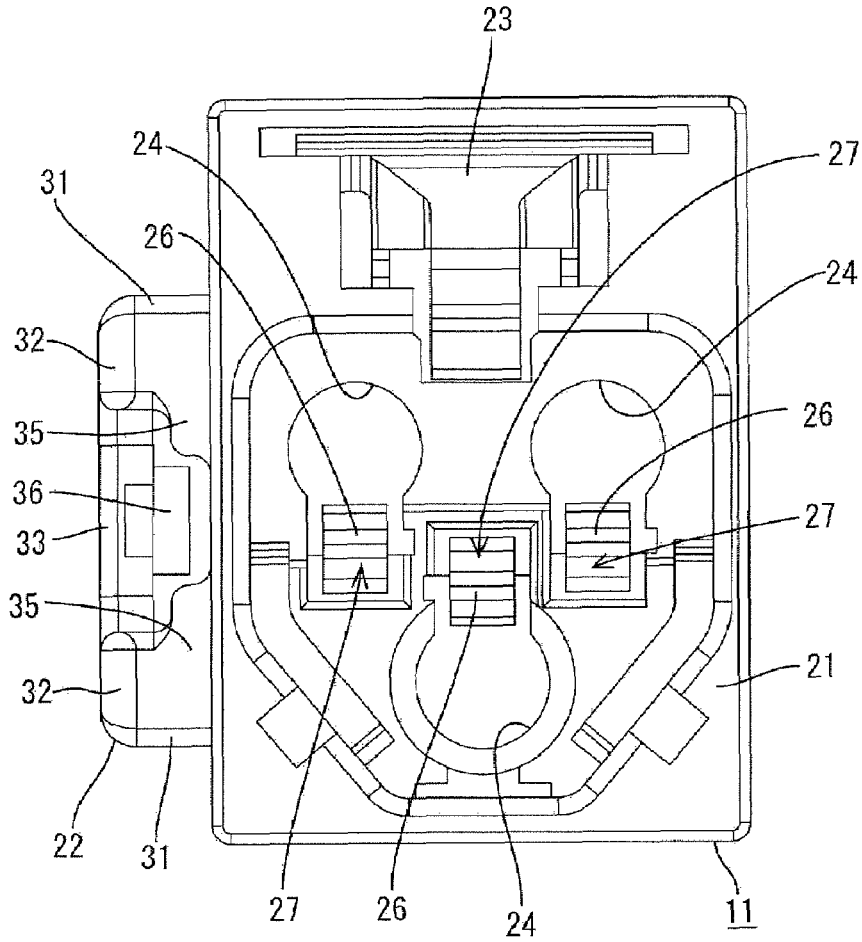
FIG. 1 is a front view of a housing of a connector according to one embodiment of the invention.
Figure 2:
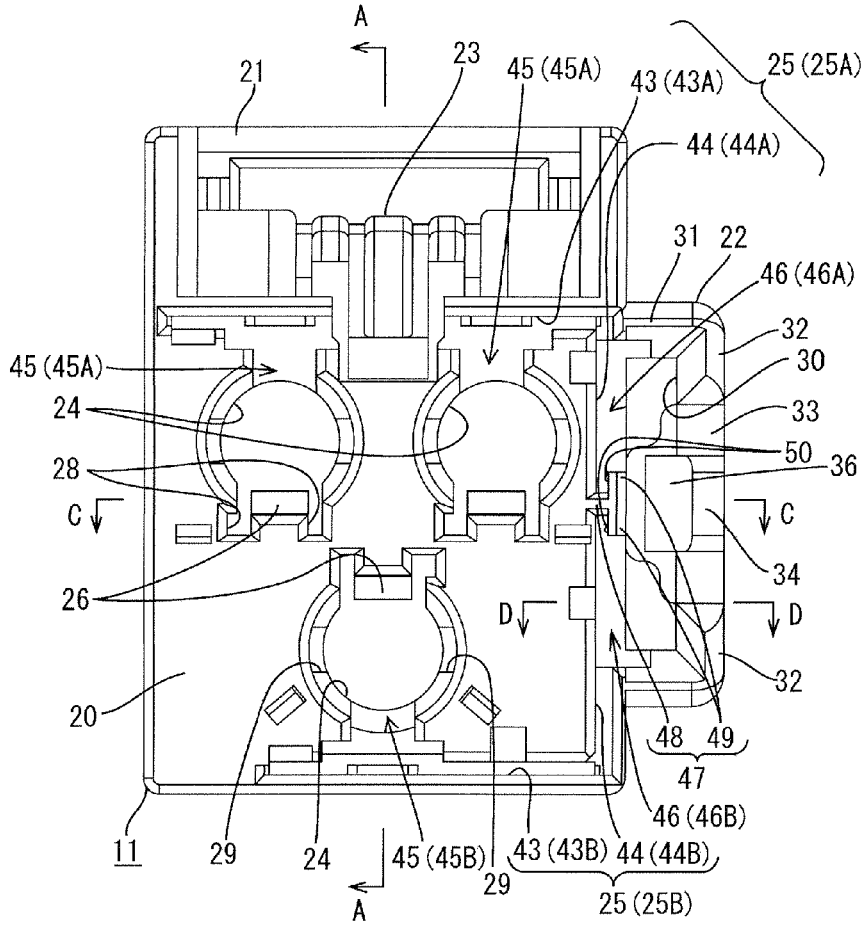
FIG. 2 is a rear view of the housing.

The housing 11 is made e.g. of synthetic resin and includes a substantially block-shaped terminal accommodating portion 20, a receptacle 21 and a bracket mounting portion 22, as shown in FIGS. 1 and 2. The terminal accommodating portion 20 accommodates the terminal fittings 12 and the split ground terminals 13. The receptacle 21 is a forwardly open substantially rectangular tube that projects forward from the terminal accommodating portion 20 and defines a connection space for receiving the mating connector. The bracket mounting portion 22 receives the bracket B, A lock arm 23 is at a widthwise intermediate position at the top of the terminal accommodating portion 20 and extends in forward and backward directions. A support connects the lock arm 23 to the terminal accommodating portion 20 so that the lock arm 23 is resiliently displaceable up and down like a seesaw in directions intersecting a connecting direction with the mating connector. Thus, the lock arm 23 can be latched to the mating connector. The upper wall of the receptacle 21 covers substantially all but an operable portion of the lock arm 23 at the rear end thereof.

The terminal accommodating portion 20 has terminal accommodating chambers 24 for accommodating the respective terminal fittings 12 and split ground terminal accommodating chambers 25 for accommodating the respective split ground terminals 13. Two terminal accommodating chambers 24 are at an upper level in the terminal accommodating portion 20 and one is at a lower level. The terminal fitting accommodating chambers 24 are displaced from each other in the width direction. Additionally, the central positions of the respective terminal accommodating chambers 24 are substantially at vertices of a right triangle.

The terminal accommodating chambers 24 penetrate the terminal accommodating portion 20 in forward and backward directions and have substantially circular shapes conforming to the outer shapes of the main portions 15 of the terminal fittings 12. Thus, the terminal fittings 12 are insertable individually into the terminal accommodating chambers 24 from behind. As shown in FIG. 12, a locking lance 26 is cantilevered from an inner peripheral surface of each terminal accommodating chamber 24 and is resiliently engageable with the lance engaging portion 18 of the inserted terminal fitting 12 to retain the terminal fitting 12. The terminal fitting 12 retained by the locking lance 26 is held so that a front part of the main portion 15 projects into the connection space (see FIG. 13).

Each locking lance 26 is resiliently deformable up and down substantially orthogonal to the inserting direction of the terminal fitting 12. As shown in FIG. 1, the locking lances 26 are arranged near ends of the inner peripheral wall surfaces of the terminal accommodating chambers 24 facing the terminal accommodating chambers in the adjacent levels. Specifically, the locking lances 26 are arranged at bottom positions in the two terminal accommodating chambers 24 in the upper level and the locking lance 26 is arranged at an upper position in the terminal accommodating chamber 24 in the lower level. Thus, the locking lances 26 in the upper and lower levels have opposite deforming directions and are in a partly overlapping positional relationship so that each locking lance 26 is adjacent to deformation spaces 27 for the locking lances 26 in the adjacent levels in the width direction. Thus, the locking lances 26 and the deformation spaces 27 are arranged efficiently to permit miniaturization of the housing 11.

As shown in FIG. 2, two rearwardly open stabilizer insertion grooves 28 are formed in the inner circumferential surface of each terminal fitting accommodating chamber 24 at opposite sides of the locking lance 26 for receiving the stabilizers 17. Further, two rearwardly open projection insertion grooves 29 are formed in the inner circumferential surface of each terminal accommodating chamber 24 at positions spaced from the two stabilizer insertion grooves 28 by an angle of about 90° for receiving the projections 19. The projections 19 engage the front edges of the projection insertion grooves 29 when the terminal fitting 12 is inserted to a proper depth for preventing further forward movement of the terminal fitting 12.

As shown in FIGS. 1 to 3, the bracket mounting portion 22 is provided on a substantially vertically extending side surface of the housing 11, and the bracket B is mounted into the bracket mounting portion 22 in a posture where the plate surfaces thereof are aligned substantially vertically.

The bracket mounting portion 22 is a rearwardly opened bottomed hole with a bracket accommodating chamber 30 therein for receiving the bracket B. More specifically, the bracket mounting portion 22 includes two side walls 31 that project from the side surface of the housing 11. Projecting walls 32 project in from the projecting ends of the side walls 31 and face the side surface of the housing 11. A bridging wall 33 extends continuously between the projecting walls 32 and a bracket locking piece 34 extends back from the bridging wall 33. A front stop wall 35 projects from the side surface of the housing 11 and is connected with the front ends of the side walls 31 and the projecting walls 32. The bracket mounting portion 22 is formed in a vertical range extending over the terminal fitting accommodating chambers 24 in the upper and lower levels. The bracket accommodating chamber 30 is dimensioned to conform to the width and the thickness of the bracket B.

The bracket locking piece 34 is cantilevered in forward and backward directions and is resiliently deformable in the width direction, which is substantially orthogonal to the inserting direction of the bracket B. A lock projection 36 is provided on the inner surface of the free end of the bracket locking piece 34 and projects into the bracket accommodating chamber 30. Thus, the housing 11 is fixed to the bracket B by engaging the lock projection 36 with the lock hole Ba of the bracket B. The bracket locking piece 34 is arranged at a vertical intermediate position of the bracket mounting portion 22 and is displaced out in the process of inserting the bracket B.

The split ground terminals 13 are shown in FIGS. 5 to 10 and each is formed by press-working an electrically conductive metallic plate. Two types of split ground terminals 13, namely, one with two poles for connecting the two terminal fittings 12 in the upper level to the bracket B and one with one pole for connecting the one terminal fitting 12 in the lower level to the bracket B. The respective split ground terminals 13 are accommodated individually into the corresponding split ground terminal accommodating chambers 25 formed in the terminal accommodating portion 20. In the following description, suffixes A, B are respectively added to the reference numerals of those for two poles and those for one pole to distinguishing the split ground terminals 13 and the split ground terminal accommodating chambers 25, while no suffixes are added to the reference numerals in the case of collectively naming them.

Each split ground terminal 13 includes a base plate 37 that extends in the width direction and forward and backward directions. A circuit-side contact piece 38 is formed by cutting the base plate 37 and bending the cut part. A side plate 39 is bent at an edge of the base plate 37 and extends vertically, and a bracket-side contact piece 40 extends from the side plate 39. The circuit-side contact piece 38 can resiliently contact the outer conductor terminal 14 of the terminal fitting 12 and the bracket-side contact piece 40 can resiliently contact the bracket B.

Figure 6:
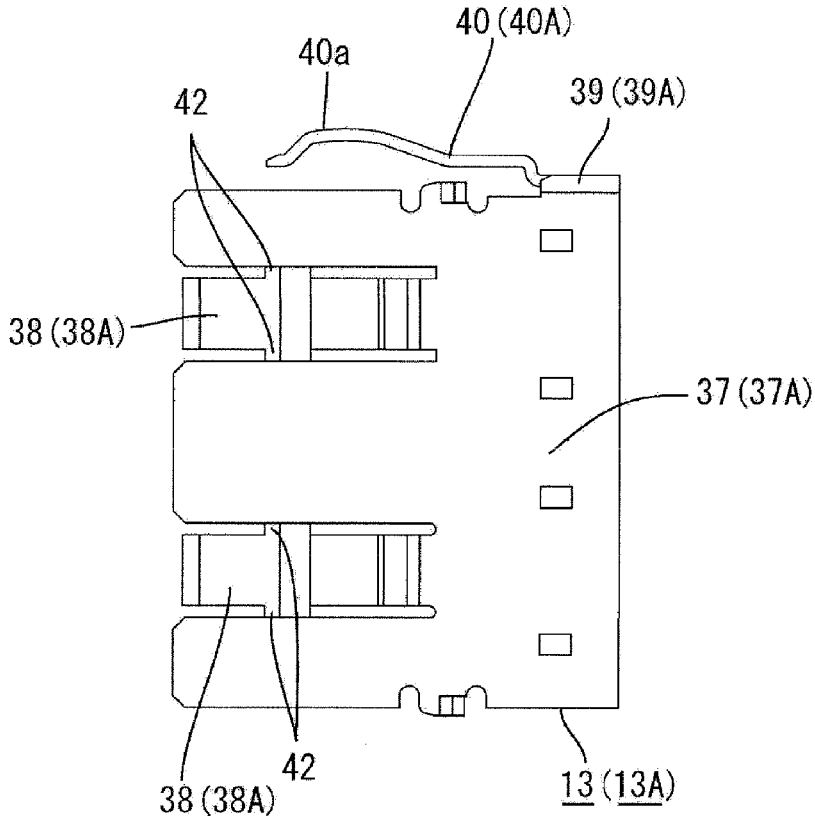
FIG. 6 is a plan view of the two-pole split ground terminal.
Figure 7:
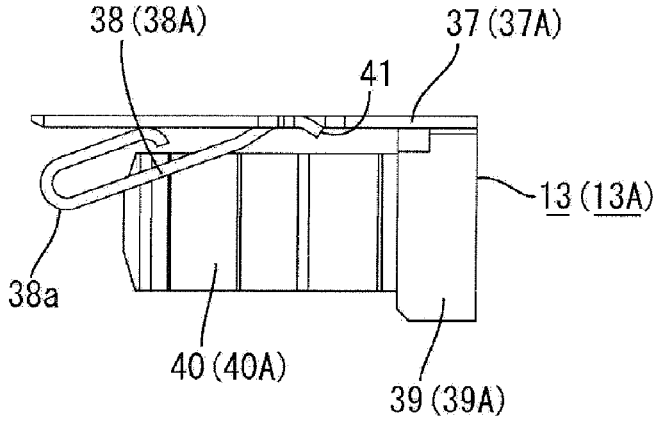
FIG. 7 is a side view of the two-pole split ground terminal.
Figure 9:
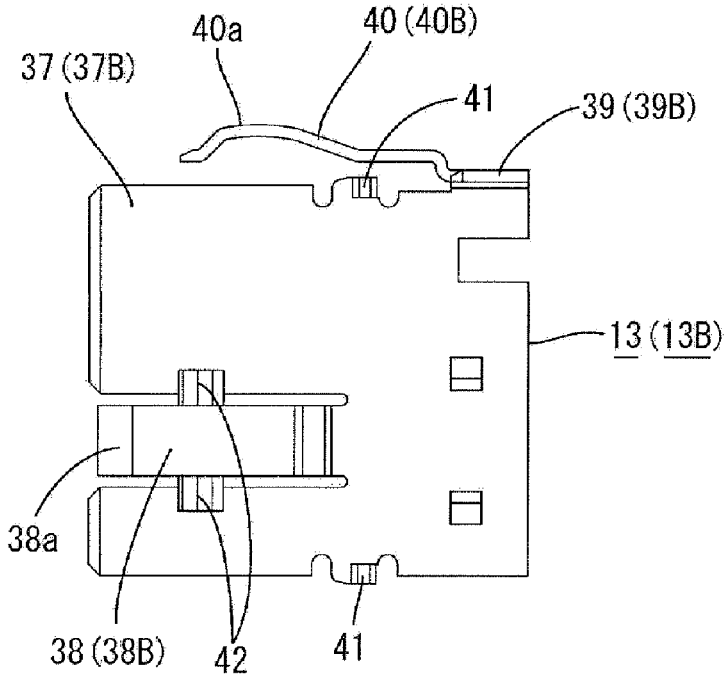
FIG. 9 is a plan view of the one-pole split ground terminal.
Figure 10:
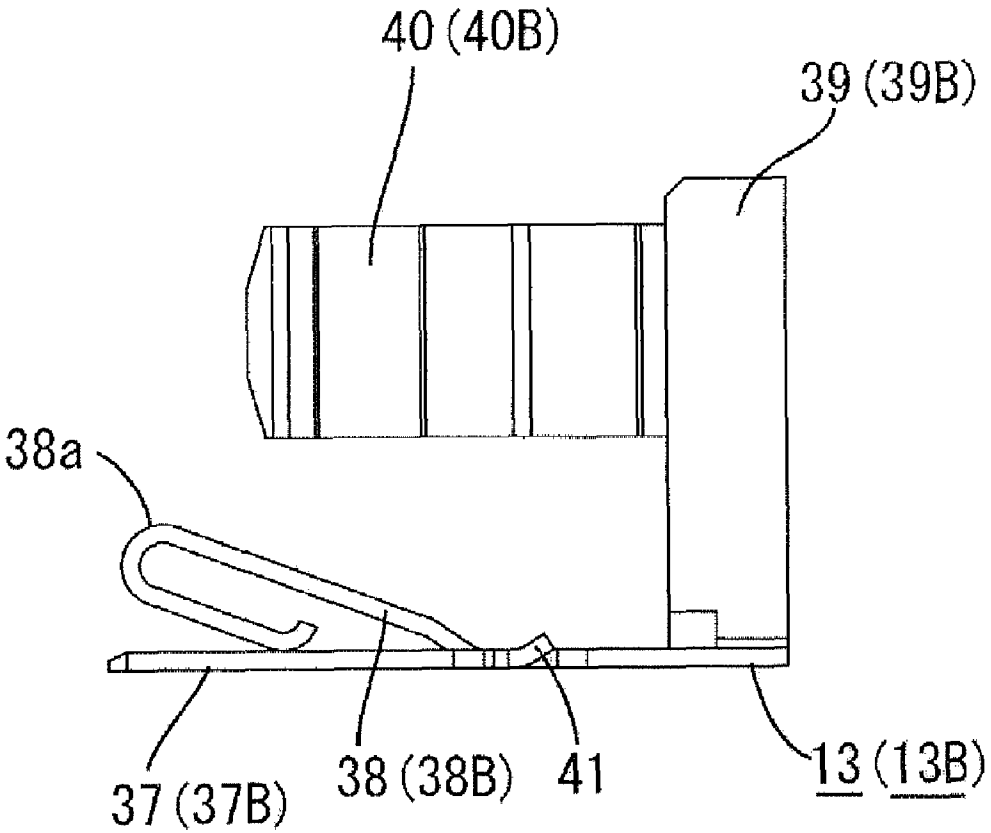
FIG. 10 is a side view of the one-pole split ground terminal.
Figure 11:
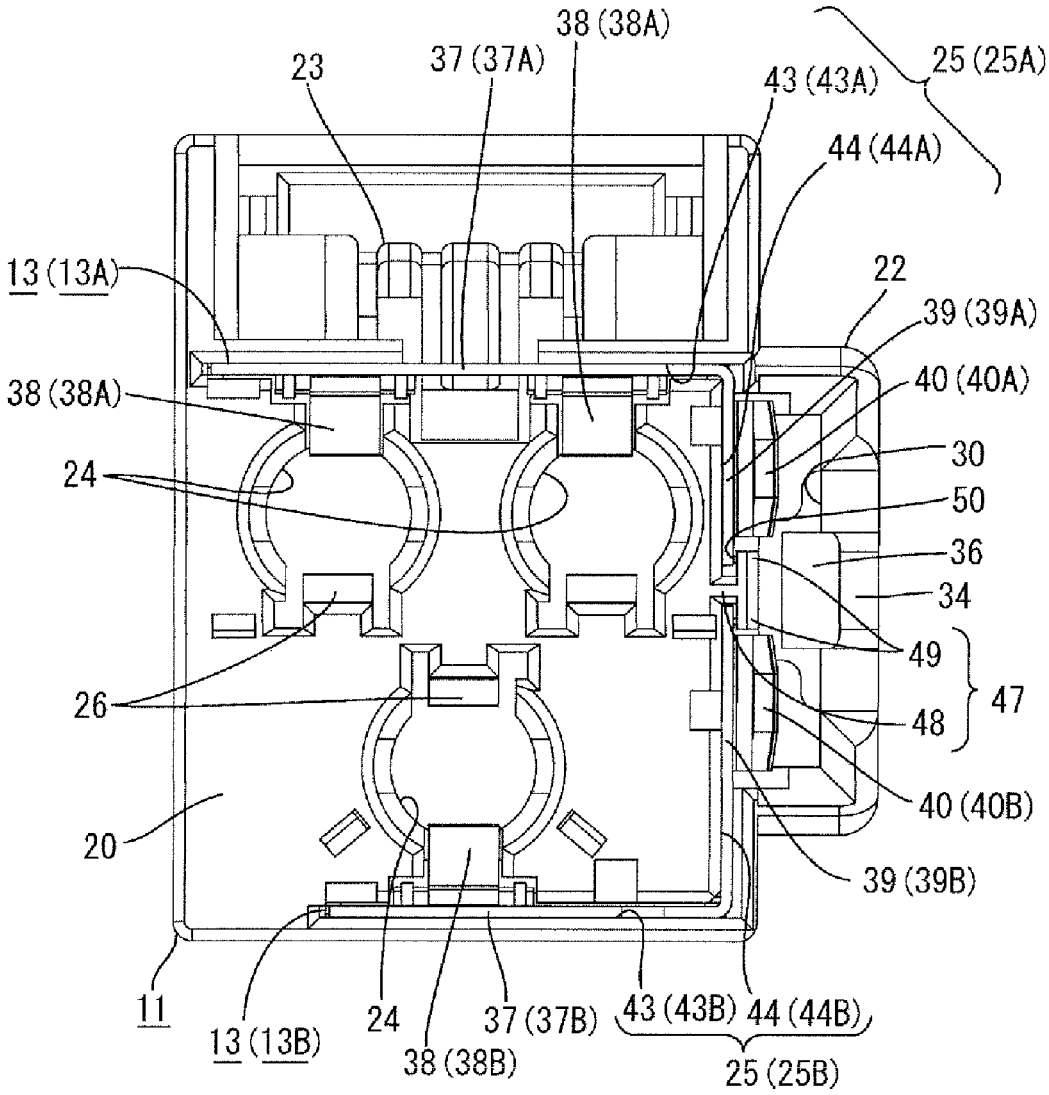
FIG. 11 is a front view showing a state where the split ground terminals are mounted in the housing.

As shown in FIGS. 6 and 9, the base plate 37 is substantially rectangular in plan view and has a length in forward and backward directions and a width that are shorter than the respective length and width of the terminal accommodating portion 20. Two retaining pieces 41 are formed by cutting and bending the opposite lateral edges of the base plate 37. The retaining pieces 41 bite in the inner wall surfaces of the split ground terminal accommodating chamber 25 so that the split ground terminal 13 does not to come out of the housing 11.

As shown in FIGS. 6, 7, 9 and 10, the circuit-side contact piece 38 is cantilevered obliquely forward between two forwardly open slits in the base plate 37 and is bent back towards the base plate 37 from a position near the front end position of the base plate 37. A contact 38a is defined on the folded part for contacting the terminal fitting 12. The circuit-side contact piece 38 is resiliently deformable vertically and substantially orthogonal to the inserting direction of the terminal fitting 12 with the base end thereof as a support. Projections 42 are formed to widen the free end of the circuit-side contact piece 38, and the projections 42 contact the plate surface of the base plate 37 to increase a resilient force of the circuit-side contact piece 38 and to prevent an excessive resilient deformation.

Figure 5:
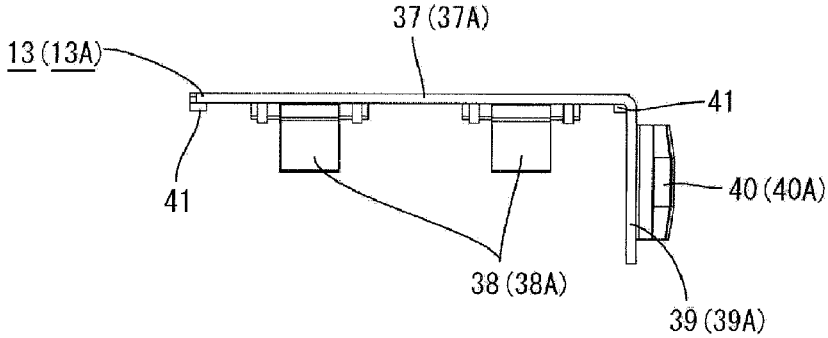
FIG. 5 is a rear view of a two-pole split ground terminal.
Figure 8:
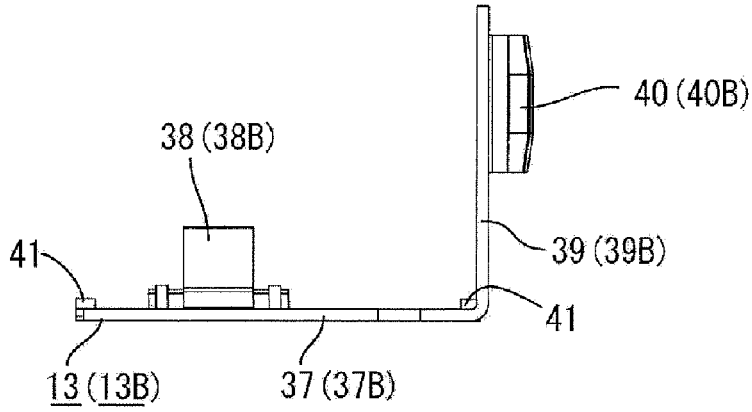
FIG. 8 is a rear view of a one-pole split ground terminal.

As shown in FIGS. 5 and 8, the side plate 39 extends substantially vertically and is formed by bending a plate piece projecting from the rear end of the base plate 37 substantially at right angles. Thus, the base plate 37 and the side plate 39 form a substantially L-shape when viewed from front or behind. The side plate 39 is narrow and long in the vertical direction, and the bracket-side contact piece 40 extends forward from the front edge thereof.

As shown in FIGS. 6 and 9, the bracket-side contact piece 40 is cantilevered forwardly from the side plate 39 and is formed into a mountain shape with a peak that defines a contact portion 40*a* at an intermediate position. Unlike the circuit-side contact piece 38, the free end of the bracket-side contact piece 40 cannot contact the base plate 37 or the side plate 39 even during the resilient deformation. The bracket-side contact piece 40 is resiliently deformable along the width direction with the base end as a support. The outer surface of the bracket-side contact piece 40 can contact the bracket B and opposite sides thereof are slanted so that an intermediate part projects more outwardly towards the bracket B in the mounted state than the opposite sides, as shown in FIGS. 5 and 8. Further, the bracket-side contact piece 40 is wider than the circuit-side contact piece 38.

The two-pole split ground terminal 13A has two circuit-side contact pieces 38A (see FIG. 5), whereas the one-pole split ground terminal 13B has only one circuit-side contact piece 38B (see FIG. 8). Accordingly, the base plate 37A of the two-pole split ground terminal 13A is wider than the base plate 37B of the one-pole split ground terminal 13B (see FIGS. 6 and 9). The two circuit-side contact pieces 38A of the two-pole split ground terminal 13A are arranged symmetrically in the width direction of the base plate 37A (see FIG. 6). On the other hand, the circuit-side contact piece 38B of the one-pole split ground terminal 13B is offset from the center of the base plate 37B towards a side opposite the side plate 39B (see FIG. 9).

Figure 14:
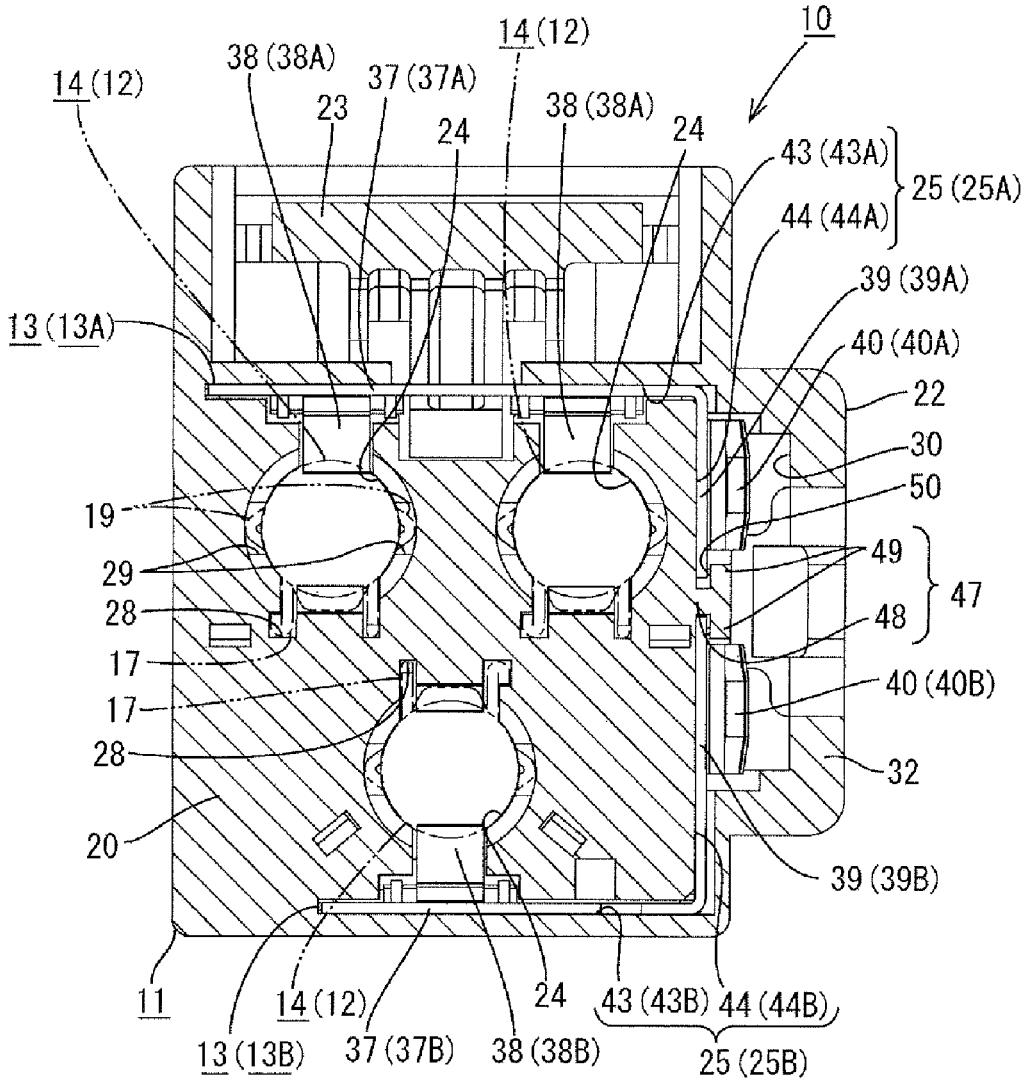
FIG. 14 is a section along B-B of FIG. 3 showing a state where the split ground terminals and the terminal fittings are mounted in the housing.

As shown in FIGS. 2 and 14, the split ground terminal accommodating chambers 25 are rearwardly open grooves arranged at positions on the connector 10 outward of the terminal fitting accommodating chambers 24 and inward of the bracket accommodating chamber 30. Each split ground terminal accommodating chamber 25 is substantially L-shaped when viewed from behind and substantially conforms to the outer shape of the corresponding split ground terminal 13. Thus, each split ground terminal accommodating chamber 25 has a base plate accommodating part 43 and a side plate accommodating part 44 that are connected. The base plate accommodating part 43 extends in the width direction and accommodates the base plate 37 and the side plate accommodating part accommodates the side plate 39.

Rearwardly open circuit-side contact piece communication spaces 45 are formed between the base plate accommodating parts 43 of the split ground terminal accommodating chambers 25 and the adjacent terminal fitting accommodating chambers 24. The circuit-side contact piece communication spaces 45 connect the accommodating chambers 24, 25 in the terminal accommodating portion 20 and permit entry of the respective circuit side contact pieces 38 into the terminal fitting accommodating chambers 24. On the other hand, bracket-side contact piece communication spaces 46 are formed in the terminal accommodating portion 20 to connect the accommodating chambers 25, 30 and to permit entry of the bracket-side contact pieces 40 into the bracket accommodating chamber 30. The bracket-side contact piece communication spaces 46 have open rear ends between the base plate accommodating parts 44 of the split ground terminal accommodating chambers 25 and the bracket accommodating chamber 30.

The two-pole split ground terminal accommodating chamber 25A is formed in an area extending from an upper end portion towards the bracket mounting portion 22 at an upper part of the right side in FIG. 2 of the terminal accommodating portion 20. More specifically, the two-pole split ground terminal accommodating chamber 25A is formed such that the base plate accommodating part 43A is above the terminal fitting accommodating chambers 24 in the upper level and the side plate accommodating part 44A is between the right terminal fitting accommodating chamber 24 in the upper level and the bracket accommodating chamber 30. Two circuit-side contact piece communication spaces 45A correspond respectively to the two terminal fitting accommodating chambers 24 in the upper level. The bracket-side contact piece communication space 46A connects the side plate accommodating part 44A arranged at the upper part of the terminal accommodating portion 20 and the upper part of the bracket accommodating chamber 30.

On the other hand, the one-pole split ground terminal accommodating chamber 25B is formed in an area from a bottom end towards the bracket mounting portion 22 at a lower part of the right end of the terminal accommodating portion 20, as shown in FIG. 2. More specifically, the one-pole split ground terminal accommodating chamber 25A is formed such that the base plate accommodating part 43B is below the terminal fitting accommodating chamber 24 in the lower level and the side plate accommodating part 44B is between the terminal fitting accommodating chamber 24 in the lower level and the bracket accommodating chamber 30. One circuit-side contact piece communication space 45B is formed to correspond to the terminal fitting accommodating chamber 24 in the lower level. The bracket-side contact piece communication space 46B connects the side plate accommodating part 44B at the lower part of the terminal accommodating portion 20 and the bottom part of the bracket accommodating chamber 30.

As described above, the bracket-side contact piece communication spaces 46 are formed between the split ground terminal accommodating chambers 25 and the bracket accommodating chamber 30 to communicate with each other. A partition 47 is formed in this communicating part for partitioning the split ground terminals 13 and the bracket B mounted in the respective accommodating chambers 25, 30. The partition 47 includes a base 48 partitioning the side plate accommodating chambers 44 of the split ground terminal accommodating chambers 25 and two projections 49 projecting up and down from the leading end of the base 48. The projections 49 partition the side plate accommodating parts 44 and the bracket accommodating chamber 30. Thus, the partition 47 is substantially T-shaped when viewed from behind.

The base 48 of the partition 47 forms part of the side walls of the side plate accommodating parts 44, whereas the projections 49 form part of the ceiling walls of the both side plate accommodating parts 44 and the bottom wall of the bracket accommodating chamber 30. The projections 49 project up to positions near ends of the bracket-side contact pieces 40, but avoid the bracket-side contact pieces 40 (see FIG. 11). Backlash preventing projections 50 are provided on the surfaces of the leading ends of the projections 49 facing the side plate accommodating parts 44 and contact ends of the side plates 39 of the split ground terminals 13. Thus, the side plates 39 will not to shake.

As shown in FIGS. 2 and 3, the partition 47 is a rib extending in forward and backward directions, in which the split ground terminal accommodating chambers 25 and the bracket accommodating chamber 30 are open. The rear end of the partition 47 is at the rear end of the housing 11 and is exposed at the rear.

The split ground terminals 13 are mounted individually into the corresponding split ground terminal accommodating chambers 25 of the housing 11 from behind. Thus, the side plate 39 is guided by the rear end of the partition 47 at the rear of the housing 11 and reliably enters the side plate accommodating part 44 without entering the bracket accommodating chamber 30.

In the mounted state, the circuit-side contact pieces 38 are at a standby state in the corresponding terminal fitting accommodating chambers 24 and the bracket-side contact pieces 40 reach a standby state in the bracket accommodating chamber 30 while being arranged one above the other as shown in FIGS. 11, 12, 15 and 17. The circuit-side contact pieces 38 are arranged at positions facing the locking lances 26, i.e. angularly displaced by about 180°. The bracket-side contact pieces 40 are arranged at substantially vertically symmetrical positions in the bracket accommodating chamber 30 and substantially vertically equidistant from the bracket lock 34 in the intermediate position. Further, in this state, the respective retaining pieces 41 bite in the inner surfaces of the split ground terminal accommodating chambers 25 to hold the split ground terminals 13 in the housing 11.

Subsequently, the respective terminal fittings 12 connected with the ends of the coaxial cables are mounted individually into the terminal fitting accommodating chambers 24 of the housing 11 from behind in a state shown in FIG. 12. The stabilizers 17 and the projections 19 are inserted respectively into the stabilizer insertion grooves 28 and the projection insertion grooves 29. Thus, the terminal fitting 12 is positioned so as not to rotate circumferentially and the insertion of the terminal fitting 12 is smooth (see FIG. 14).

Figure 13:
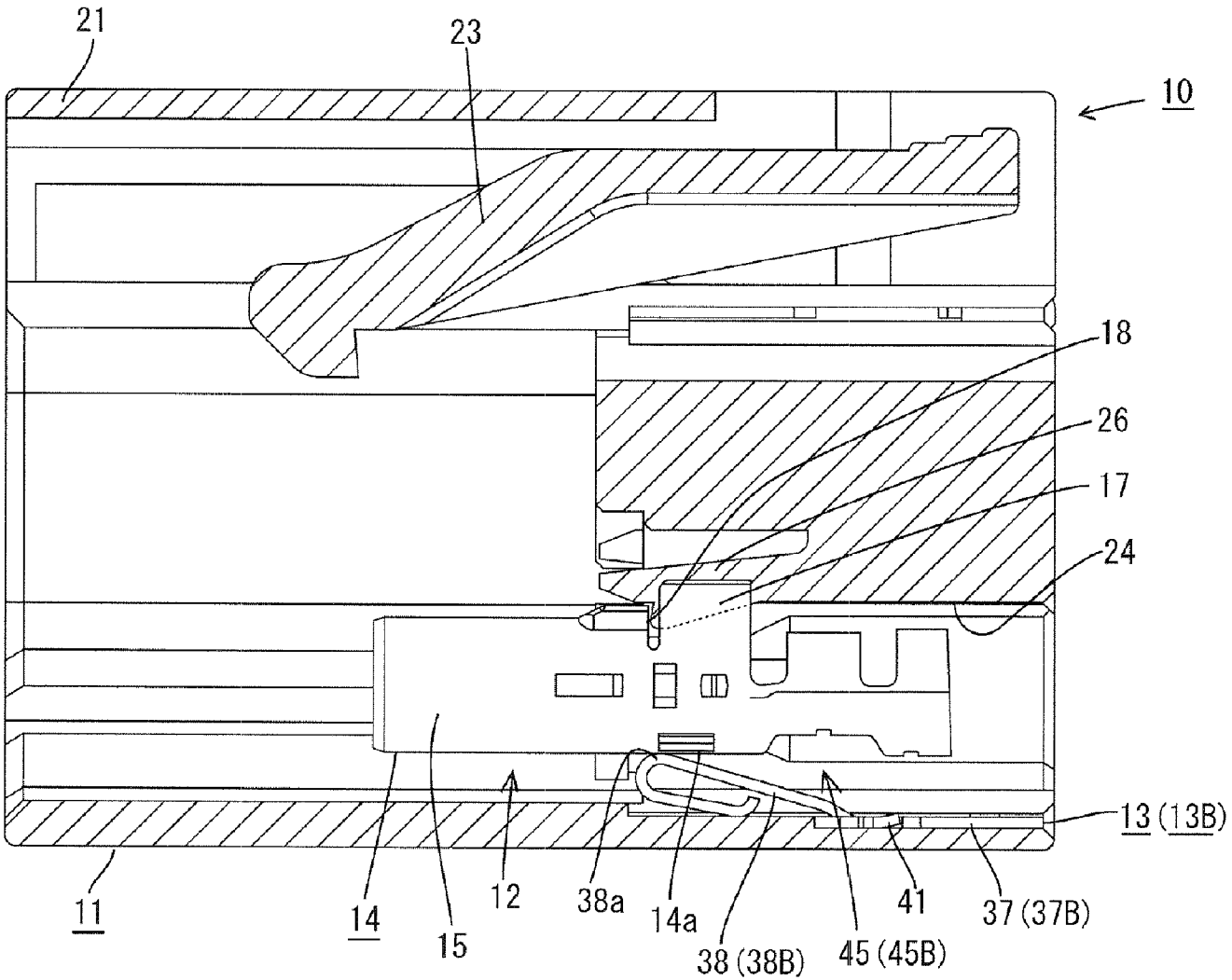
FIG. 13 is a section along A-A of FIG. 2 showing a state where the terminal fittings are inserted into the housing mounted with the split ground terminals.

In the insertion procedure, the terminal fitting 12 deforms both the locking lance 26 and the circuit-side contact pieces 38. However, the locking lance 26 is restored resiliently when the terminal fitting 12 reaches a proper depth. Thus, the locking lance 26 engages the lance engaging portion 18, as shown in FIG. 13, and prevents the terminal fitting 12 from coming out of the housing 11. In this mounted state, as shown in FIGS. 13 and 14, the circuit-side contact piece 38 resiliently contacts the bottom plate 14*a* of the outer conductor terminal 14 in the terminal fitting 12 from the outer side of the connector 10 with respect to the arranging direction of the levels of the terminal fittings. Accordingly, the terminal fitting 12 is sandwiched between the locking lance 26 and the circuit-side contact piece 38.

Figure 17:
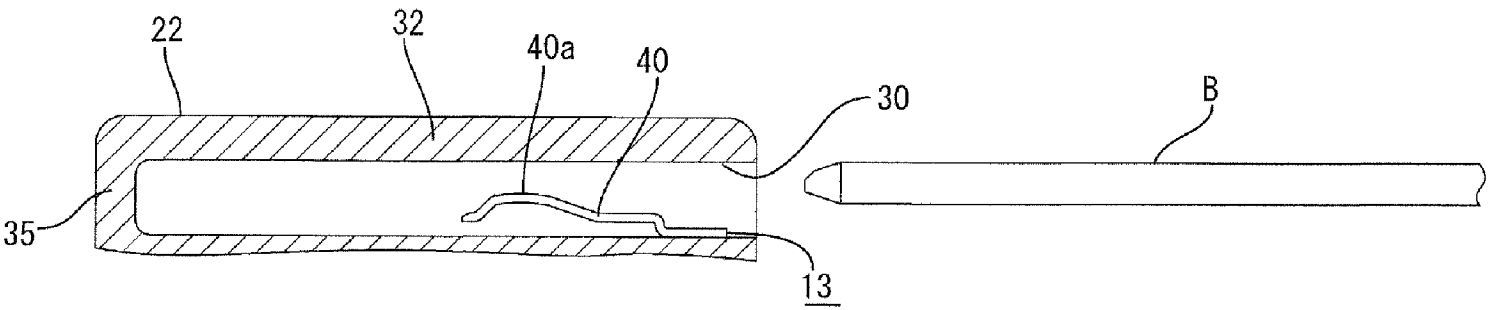
FIG. 17 is a section along D-D of FIG. 2 showing a state before the bracket is inserted.

The bracket B is mounted into the housing 11 from behind in the state shown in FIGS. 15 and 17 after all of the terminal fittings 12 are mounted. More particularly, the rear end of the partition 47 at the rear end of the housing 11 guides the bracket B reliably into the bracket accommodating chamber 30 without entering the side plate accommodating parts 44.

Figure 16:
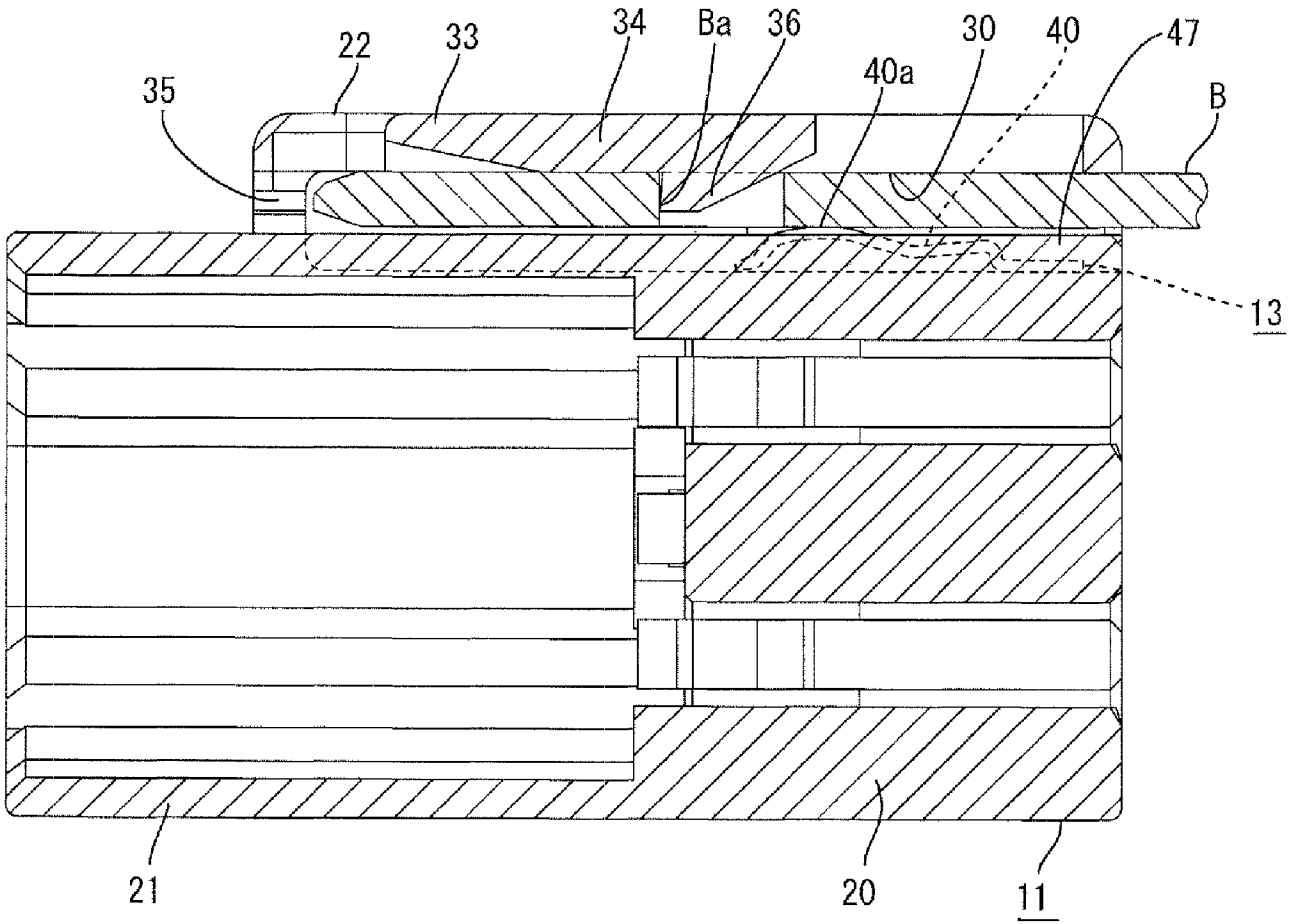
FIG. 16 is a section along C-C of FIG. 2 showing a state where the bracket is inserted into the housing mounted with the split ground terminals and the terminal fittings.
Figure 18:
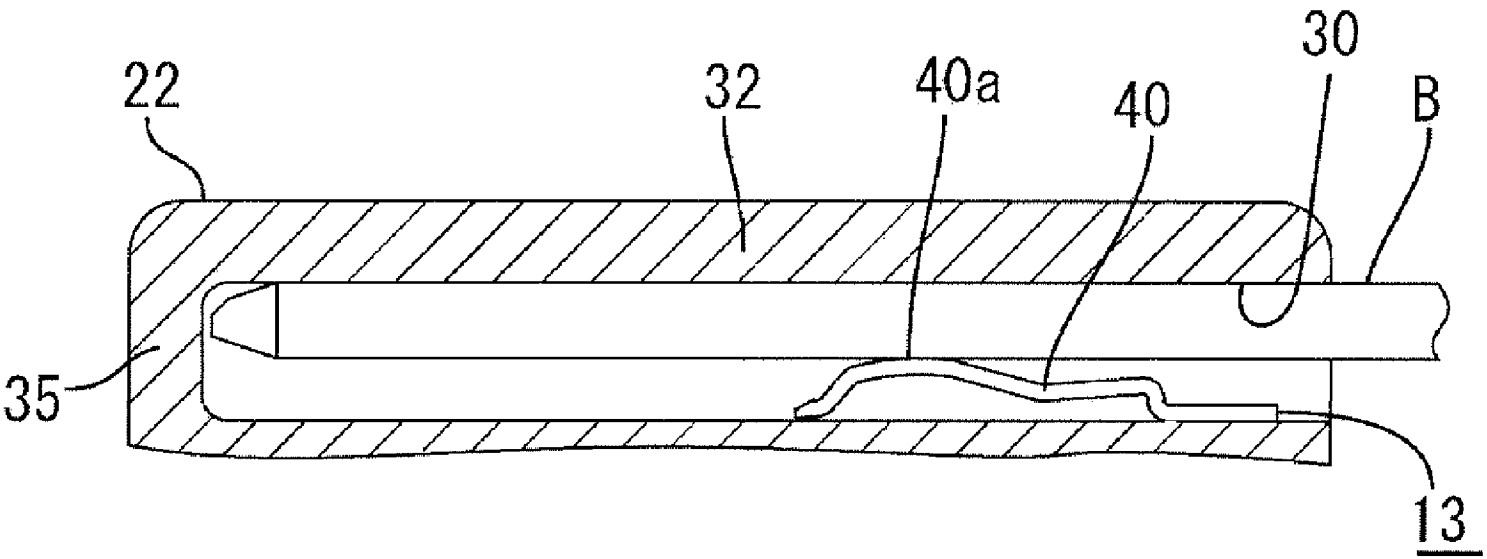
FIG. 18 is a section along D-D of FIG. 2 showing a state where the bracket is inserted.
Figure 19:
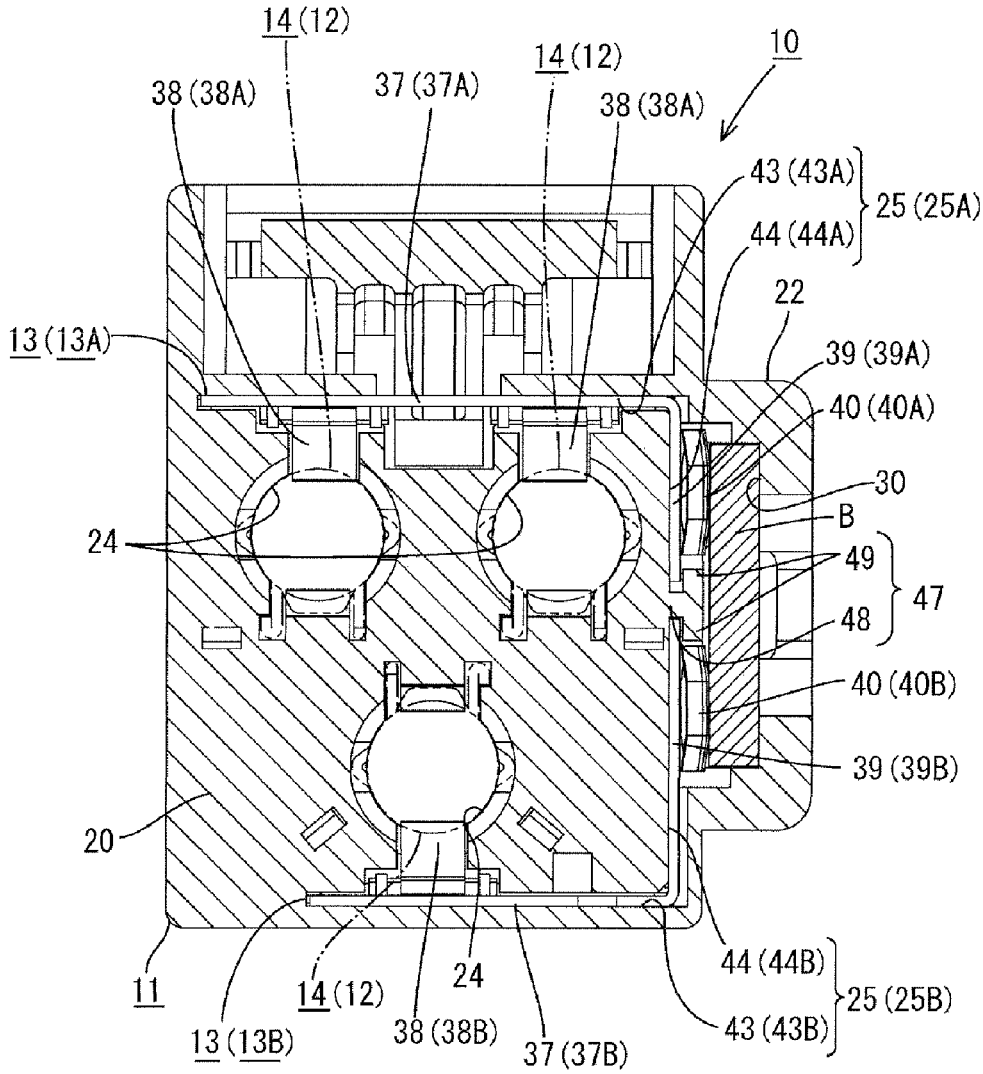
FIG. 19 is a section along B-B of FIG. 3 showing a state where the split ground terminals, the terminal fittings and the bracket are mounted in the housing.

The bracket B deforms the locking piece 34 temporarily out and deforms the bracket-side contact pieces 40 inwardly. The lock projection 36 enters the lock hole Ba and the bracket locking piece 34 is restored to engage the lock projection 36 with the edge of the lock hole Ba when the bracket B reaches a proper depth as shown in FIG. 16. Thus, the housing 11 is held so as not to come off the bracket B. In this mounted state, as shown in FIGS. 18 and 19, the bracket-side contact pieces 40 (arranged one above the other in the arranging direction of the levels of the terminal fittings 12) resiliently contact the same plate surface of the bracket B facing the inner side of the connector 10 (side substantially opposite to the bracket locking piece 34). The both bracket-side contact pieces 40 contact the bracket B at substantially vertically symmetrical positions.

The circuit-side contact pieces 38 of the split ground terminals 13 contact the outer conductor terminals 14 of the corresponding terminal fittings 12 and the bracket-side contact pieces 40 contact the bracket when the housing 11 is mounted on the bracket B. Thus, the outer conductors, as the ground wires of the respective coaxial cables, are connected electrically with the bracket B via the outer conductor terminals 14 and the split ground terminals 13 for grounding.

Figure 20:
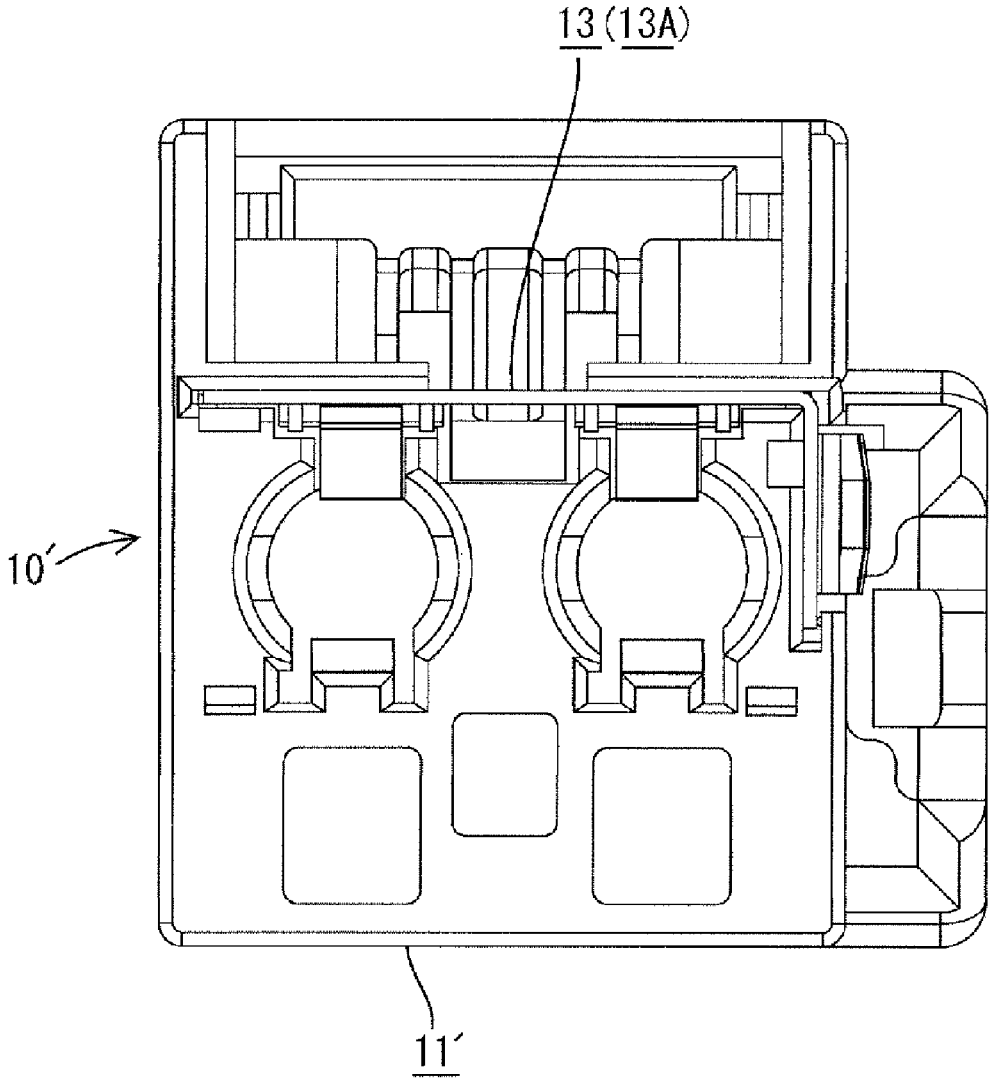
FIG. 20 is a front view showing a state where a two-pole split ground terminal is mounted in a two-pole connector housing.

The split ground terminals 13 used in the above-described connector 10 also can be used in a connector with different numbers of coaxial cables and terminal fittings 12 by making the construction of this alternate housing partly common to the housing 11 of the connector 10. Specifically, FIG. 20 shows a two-pole connector 10' using two coaxial cables and two terminal fittings 12 with a housing constructed by omitting the one-pole split ground terminal accommodating chamber 25B from the above-described three-pole connector 10. The two-pole split ground terminal 13A may be mounted in this housing 11'. An unillustrated one-pole connector can use the one-pole split ground terminal 13B with a housing constructed by omitting the two-pole split ground terminal accommodating chamber 25A. By doing so, the split ground terminals 13 can be commonly used in a plurality of types of connectors with different numbers of poles. Therefore lower cost can be promoted as compared with the case where split ground terminals are produced as special parts for the respective types of connectors.

As described above, a plurality of split ground terminals 13 including the circuit-side contact pieces 38 that contact the respective terminal fittings 12 and the bracket-side contact piece 40 that contacts the bracket B are mounted in the housing 11. Thus, as compared with the case where one ground terminal is provided with all the circuit-side contact pieces 38, the individual split ground terminals 13 can be made smaller and the structures thereof can be simplified to facilitate production. Therefore, the connector 10 suitable for electrically connecting the ground wires of a plurality of coaxial cables and the bracket B can be obtained.

The partition 47 partitioning the bracket B and the split ground terminals 13 avoids the bracket-side contact pieces 40 between the bracket B and the split ground terminals 13 in the housing 11. Thus, the bracket B and the split ground terminals 13 can be positioned relative to each other, and the entrance of either one of them into the accommodating chamber for the other can be prevented.

Further, the bracket B and the split ground terminals 13 are mounted into the housing 11 in the same direction and the partition 47 is exposed at the front end of the housing 11 with respect to the mounting direction of the bracket B and the split ground terminals 13. Thus, the partition 47 guides the mounting of the bracket B and the split ground terminals 13 and operability is good.

The respective bracket-side contact pieces 40 are arranged substantially in one direction and are brought into contact with the same plate surface of the bracket B. Thus, the bracket B can have a substantially straight shape to simplify the construction of the housing 11 into which the bracket B is mounted.

The terminal fittings 12 are arranged in levels in the housing 11. Further, the circuit-side contact pieces 38 contact the terminal fittings 12 from the outer sides with respect to the arranging direction of the levels of the terminal fittings 12 and the bracket-side contact pieces 40 are arranged substantially in the arranging direction of the levels of the terminal fittings 12. Thus, arrangement efficiency in the multilevel type connector 10 is improved, enabling the miniaturization of the connector 10.

Furthermore, the bracket-side contact pieces 40 contact the bracket B at substantially symmetrical positions. Hence, they can touch the bracket B in a well-balanced manner, to obtain a good contact performance.

The terminal fittings are in plural levels and in an offset manner with the adjacent ones displaced from each other. Thus, the arrangement efficiency of the terminal fittings 12 in the housing 11 is improved and is suited for miniaturization.

The locking lances 26 are arranged at the sides of the terminal fittings 12 opposite to the circuit-side contact pieces 38 in the housing 11 and resiliently engage the mounted terminal fittings 12. Thus, the terminal fittings 12 are received resiliently by the locking lances 26 to keep the terminal fittings 12 and the circuit-side contact pieces 38 in a good contact state.

Further, the bracket locking piece 34 of the housing is engageable with the bracket B and is arranged at the side of the bracket B substantially opposite to the bracket-side contact pieces 40. Thus, the bracket B can be narrower and the connector 10 can be made smaller as compared with the case where the bracket-side contact pieces and the bracket locking piece are arranged at the same side.

The invention is not limited to the above described and illustrated embodiment. For example, the following embodiments are also embraced by the technical scope of the present invention as defined by the claims.

Each split ground terminal has the base plate and the side plate and is substantially L-shaped in the above embodiment. However, the side plate may be omitted by providing the bracket-side contact piece on the base plate. Thus, the base plate of the split ground terminal may be arranged between the terminal fitting and the bracket and the circuit-side contact pieces and the bracket-side contact piece may project in opposite directions from the base plate.

Although the ground terminal is split into two pieces in the above embodiment, it may be split into three or more pieces.

Although the split ground terminal includes one or two circuit-side contact pieces in the above embodiment, split ground terminals including three or more circuit-side contact pieces also are embraced by the present invention.

The connectors including one to three coaxial cables and one to three terminal fittings in the above embodiment. However, the invention also is applicable to connectors with four or more coaxial cables and four or more terminal fittings.

The connector has the terminal fittings arranged in the two levels in the above embodiment. However, the invention also is applicable to connectors with terminal fittings arranged in three or more levels. In such a case, the respective circuit-side contact pieces of the split ground terminals can be brought into contact with the terminal fittings from outer sides with respect to the arranging direction of the levels of the terminal fittings by arranging the terminal fittings in the respective levels in an offset manner in the housing. Conversely, the invention also is applicable to a connector with terminal fittings arranged in one level.

The circuit-side contact pieces are brought into contact with the outer conductor terminals of the terminal fittings in the above embodiment. However, they may be directly brought into contact with the outer conductors of the coaxial cables according to the invention.

The terminal fittings are connectable with the ends of the coaxial cables in the above embodiment. However, the invention also is applicable to connectors using terminal fittings connected with ends of normal insulated cables having no outer conductors and no outer sheaths. In such a case, cores of the insulated cables may constitute ground wires of an electric circuit.

The terminal fittings are connectable directly with the ends of the coaxial cables in the above embodiment. However, they need not be connectable directly with cables. For example, the invention is applicable to connectors with intermediate terminals having opposite ends connected with mating terminals directly connected with cables. In short, the connector may include an intermediate terminal connected with a cable via a mating terminal.

The circuit-side contact pieces and the bracket-side contact pieces both are resiliently deformable cantilevers in the above embodiment. However, they may be supported at both ends or may be parts that are not resiliently deformable. If the circuit-side contact pieces and the bracket-side contact pieces cannot be deformed resiliently, the mating terminal fittings or the bracket may include contact parts that are resiliently deformable.

Although the main portion of the outer conductor terminal of the terminal fitting has a substantially cylindrical shape in the above embodiment, it may have, for example, a box shape, a rectangular or polygonal shape or the like.

The terminal fittings are arranged in an offset manner in the housing in the above embodiment. However, the invention is applicable to connectors with terminal fittings arranged in a lattice.

A cantilevered bracket locking piece is provided at the outer wall of the bracket mounting portion in the above embodiment. However, the locking piece may be at the inner wall (side toward the bracket-side contact pieces) of the bracket mounting portion. Besides, the bracket may have at least one lock and the bracket mounting portion may have at least one part engageable with the lock. Further, the bracket may be pressed into the bracket mounting portion by omitting the locking piece and the like.

One bracket with a substantially straight shape is described above. However, plural brackets may be used for a housing with plural bracket mounting portions. Further, the shape of the bracket may be changed to have, for example, an L-shaped cross section depending on the shape of the bracket mounting portion.

The locking lances are at the sides of the terminal fittings opposite to the circuit-side contact pieces in the above embodiment. However, the angular interval between the terminal fittings and the locking lances may be different from 180°.

The lock arm for holding the mating connector may be arranged at a position substantially opposite to the bracket mounting portion in the housing.

What is claimed is:

1. A connector, comprising:

a housing to be mounted on an electrically conductive bracket;

terminal fittings arranged at plural levels in the housing for connection with cables, including ground wires; and split ground terminals each including at least one circuit-side contact to be connected with the ground wire or with the terminal fitting connected with the ground wire and at least one bracket-side contact to be connected with the bracket and mounted in the housing, the respective circuit-side contacts being brought into contact with the ground wires or the terminal fittings connected with the ground wires from outer sides with respect to an arranging direction of the levels of the terminal fittings and the respective bracket-side contacts being arranged in the arranging direction of the levels of the terminal fittings and being brought into contact with the bracket at substantially symmetrical positions.

2. The connector of claim 1, wherein at least one partition is provided in the housing between the bracket and the split ground terminals at a position avoiding the bracket-side contacts for partitioning the bracket and the split ground terminals.

3. The connector of claim 2, wherein the bracket and the split ground terminals are mounted into the housing in a common direction and the partition is exposed in a front end of the housing with respect to the mounting direction of the bracket and the split ground terminals.

4. The connector of claim 1, wherein the respective bracket-side contacts are arranged in one direction and are brought into contact with the same plate surface of the bracket.

5. A connector, comprising:

a housing having three terminal fitting accommodating chambers, a bracket accommodating chamber and two split ground terminal accommodating chambers, each split ground terminal accommodating chamber having at least one circuit-side communication space communicating with at least one of the terminal fitting accommodating chambers and further having a bracket-side communication space communicating with the bracket accommodating chamber; and split ground terminals mounted respectively in the split ground terminal accommodating chambers, one of the split ground terminals including a circuit-side contact projecting through one of the circuit-side communication spaces and into one of the corresponding terminal fitting accommodating chambers, a second of the split ground terminals including two circuit-site contacts projecting through two of the circuit-side communication spaces and into the corresponding terminal fitting accommodating chambers, each split ground terminal further having a bracket-side contact projecting through the bracket-side communication space and into the bracket accommodating chamber.

6. The connector of claim 5, wherein two of the three terminal fitting accommodating chambers are arranged at a first level in the housing and a third of the three terminal fitting accommodating chambers are arranged at a second level in the housing.

7. The connector of claim 1, wherein the terminal fittings in adjacent levels are offset from each other.

8. The connector of claim 7, wherein the circuit-side contacts are brought into contact with the terminal fittings, the housing includes terminal-fitting retaining pieces resiliently engageable with the mounted terminal fittings, and the terminal-fitting retaining pieces are arranged at sides of the terminal fittings opposite to the circuit-side contacts.

9. The connector of claim 1, wherein the housing includes a bracket lock for locking the bracket, and the bracket lock is arranged at a side of the bracket substantially opposite to the bracket-side contacts.

10. The connector of claim6, wherein the three terminal fitting accommodating chambers are arranged between the circuit-side communication spaces.

11. The connector of claim 5, wherein each of the split ground terminals has a main plate and a side plate, the circuit-side contact projecting resiliently from the main plate, the bracket-side contact projecting resiliently from the side plate.

12. The connector of claim 11, wherein the main plate of at least one of the split ground terminals has two circuit-side contacts projecting resiliently therefrom.

13. The connector of claim 12, wherein the housing has at least one partition separating the bracket-side communication spaces of the two split ground terminal accommodating chambers from one another.

14. The connector of claim 13, wherein the partition is disposed to separate the side plates of the split ground terminals from the bracket accommodating chamber.

15. The connector of claim 11, wherein the main plate of each of the split ground terminals is substantially orthogonal to the side plate thereof.

16. The connector of claim 15, wherein the main plates of the two split ground terminals are substantially parallel and the side plates of the two split ground terminals are substantially coplanar.

* * * * *